US010954710B2

(12) United States Patent
Pellegrini

(10) Patent No.: US 10,954,710 B2
(45) Date of Patent: Mar. 23, 2021

(54) SPINDLE DRIVE WITH INTEGRATED LOCKING

(71) Applicant: GEBR. BODE GMBH & CO. KG, Kassel (DE)

(72) Inventor: Andreas Pellegrini, Edermünde (DE)

(73) Assignee: GEBR. BODE GMBH & CO. KG, Kassel (DE)

( * ) Notice: Subject to any disclaimer, the term of this patent is extended or adjusted under 35 U.S.C. 154(b) by 0 days.

(21) Appl. No.: 15/767,553

(22) PCT Filed: Oct. 12, 2016

(86) PCT No.: PCT/EP2016/074507
§ 371 (c)(1),
(2) Date: Apr. 11, 2018

(87) PCT Pub. No.: WO2017/064140
PCT Pub. Date: Apr. 20, 2017

(65) Prior Publication Data

US 2018/0291670 A1 Oct. 11, 2018

(30) Foreign Application Priority Data

Oct. 12, 2015 (DE) ..... 20 2015 105 385.1

(51) Int. Cl.
*E05F 15/652* (2015.01)
*E05F 15/622* (2015.01)

(52) U.S. Cl.
CPC ..... *E05F 15/652* (2015.01); *E05F 15/622* (2015.01); *E05Y 2201/22* (2013.01); *E05Y 2201/64* (2013.01); *E05Y 2201/70* (2013.01)

(58) Field of Classification Search
CPC .. E05F 15/652; E05F 15/622; E05Y 2201/70; F16H 25/2006
See application file for complete search history.

(56) References Cited

U.S. PATENT DOCUMENTS 4,198,786 A * 4/1980 Monot ..... B61D 19/02 49/362
4,821,456 A * 4/1989 Nogaki ..... E05F 15/673 49/362

(Continued)

FOREIGN PATENT DOCUMENTS

FR 2417620 A1 9/1979

OTHER PUBLICATIONS

International Search Report dated Jan. 3, 2017 re: Application No. PCT/EP2016/074507; pp. 1-2; citing: FR 2 417 620 A1.

*Primary Examiner* — Catherine A Kelly
(74) *Attorney, Agent, or Firm* — Cantor Colburn LLP

(57) ABSTRACT

A spindle drive for a member to be driven includes a driven spindle with a longitudinal axis extending through a spindle nut. The spindle drive includes the spindle nut having a pusher dog with first and second contact surfaces for driving the member. The contact surfaces are oriented in opposite directions to each other along the longitudinal axis of the spindle.

First and second drive surfaces are provided, facing each other and spaced apart from each other along the longitudinal axis of the spindle.

A distance between the two drive surfaces exceeds a distance between the contact surfaces. The spindle drive further includes an actuator provided connected to the spindle nut for actuating another device, when the pusher dog between the drive surfaces is being displaced.

2 Claims, 2 Drawing Sheets

(56) References Cited

U.S. PATENT DOCUMENTS

| | | | | |
|---|---|---|---|---|
| 5,077,938 | A * | 1/1992 | Moreuil | E05F 15/652 49/362 |
| 5,826,377 | A * | 10/1998 | Simson | E05D 15/066 49/362 |
| 6,282,970 | B1 * | 9/2001 | Oakley | E05F 15/652 74/89.14 |
| 6,718,694 | B2 * | 4/2004 | Stojc | F16H 25/24 49/362 |
| 8,430,446 | B2 * | 4/2013 | Frieb-Preis | F16H 25/20 296/146.4 |
| 8,661,731 | B2 * | 3/2014 | Lee | E05F 15/652 49/116 |
| 8,661,733 | B2 * | 3/2014 | Lee | E05B 47/0012 49/116 |
| 9,085,921 | B2 * | 7/2015 | Pellegrini | E05B 81/14 |
| 10,190,344 | B2 * | 1/2019 | Reddmann | E05F 15/627 |

* cited by examiner

SPINDLE DRIVE WITH INTEGRATED LOCKING

TECHNICAL FIELD

The present disclosure relates to a spindle drive for a member to be driven, especially a door wing or a window wing of a vehicle, comprising a driven spindle having a longitudinal axis, which extends through a spindle nut, so that the spindle nut is displaceable by the rotation of the spindle along the longitudinal axis of the spindle.

Such a spindle drive, for example, is used to open and close sliding doors or window wings. In the following, the disclosure will be described for the use with a door wing, but it is not intended to be limited thereto. Basically, the disclosure is suitable for all drive systems, which comprise a spindle.

BACKGROUND

Usually, the spindle nut is connected to the door wing via the pusher dog, so that the door wing opens or closes an open door when the spindle is being rotated. Besides movement of the door wing, other measures are often required or desirable, for example separately locking or opening the door wing, respectively. For this, separate locking members are commonly used, which are operated via work cable or linkages. Alternatively, locking may also be done via the engine brake of the spindle drive. All systems require additional construction space and are high in cost and maintenance.

SUMMARY

The present disclosure provides a spindle drive, which, on the one hand, enables movement of a member, for example, a door wing or window wing, and, on the other hand, for example, wherein locking the door wing is smoothly possible. The disadvantages of the state of the art are to be avoided, in particular, the spindle drive is required to occupy little construction space and to have as few as possible components. Furthermore, the spindle drive is to be of low cost and maintenance.

According to the disclosure, this will be achieved by providing a spindle drive comprising a driven spindle with a longitudinal axis, which extends through a spindle nut, wherein the spindle nut comprises a pusher dog having first and second contact surfaces for driving the member that are oriented in opposite directions to each other along the longitudinal axis, first and second drive surfaces facing each other and spaced apart from each other along the longitudinal axis of the spindle, a distance between the two drive surfaces exceeds a distance between the contact surfaces, and an actuator connected to the spindle nut for actuating another device, when the pusher dog between the drive surfaces is being displaced.

Thus, the disclosure is based on the finding that the spindle nut that is driven in any case, is made use of not only for driving the member to be moved, for example, the door wing, but instead, also drives at least another member, for example, a locking device. For this purpose, the spindle nut not only is directly or indirectly connected to the door wing, but besides, is also connected to another actuator. With the spindle being driven, the spindle nut starts travelling along the longitudinal axis of the spindle, but does not drive the door wing initially. While the spindle nut moves at the beginning of travel path, only one actuator of the remaining system is being operated, for example of the locking system. According to the disclosure, this first path section of the travel path, where the pusher dog does not displace the door wing yet, may range from some millimeters up to some centimeters, preferably about from 0.5 cm to 2 cm.

As soon as the spindle is set into rotation, the spindle nut first drives the locking mechanism via the actuator and unlocks the door. Subsequently, the pusher dog of the spindle nut contacts a drive surface of a drive member for the door wing via its contact surface, thus displacing the door wing.

The two contact surfaces of the pusher dog of the spindle nut are facing in opposite directions along the longitudinal axis of the spindle nut. The two drive surfaces are disposed along the longitudinal axis of the spindle spaced apart from each other, and facing each other, so that the pusher dog with contact surfaces is located therebetween.

Locking of the door, for example, may be done in an inverse order by making use of a lock with a falling latch or a snap lock. Accordingly, if the door wing is moved into the door opening, a snap lock or a lock with a falling latch automatically. For example, use of a rotary latch has been proven to be especially suitable, which may be opened or rotated, respectively, via the movement of the spindle nut.

For the operation according to the disclosure, it is essential for the two drive surfaces of the drive member of the door wing to have a greater distance from each other along the longitudinal axis of the spindle than the two contact surfaces of the pusher dog of the spindle nut.

The difference between the distance of the two drive surfaces and the distance of the two contact surfaces is essential to the path length, by which the spindle nut may be displaced, before the drive member is being contacted and displaced, or for the movement, which is available for locking via the actuator, respectively.

The drive member and the two drive surfaces may be components of a spindle nut housing, in which the spindle nut moves. In this case, the pusher dog of the spindle nut projects into an elongated hole extending parallel to the longitudinal axis and disposed on the spindle nut housing. The spindle nut housing, in turn, is firmly connected to the door wing, and driving the door wing. Due to the elongated hole, it is possible for the pusher dog to be moved along the elongated hole, when travelling the spindle nut, without displacing the spindle nut housing. It is not before the pusher dog with its contact surface anterior to the direction of movement reaches the end of the elongated hole, that the force will be transferred via the contact surface of the pusher dog to the drive surface of the elongated hole and that the spindle nut housing will be displaced. The length of the elongated hole thereby determines the movement available for displacing the additional actuator. The actuator is firmly connected to the spindle nut and will be displaced, when the pusher dog of the spindle nut will be in contact with one of the drive surfaces.

Instead of a locking mechanism, the actuator may actuate any other mechanism, for example an acoustic or visual signaling means. This primarily depends on the field of application of the spindle drive according to the disclosure.

In an especially advantageous embodiment, there may be provided an auxiliary spindle nut, through which the spindle also extends. The auxiliary spindle nut is for stabilizing the overall system and is not displaceable between two drive surfaces, but is fixedly disposed in the spindle nut housing. In order to avoid the spindle nut housing already to be displaced by movement of the auxiliary spindle nut, said auxiliary spindle nut on its thread has a clearance to the male thread of the spindle, which corresponds to the distance of the two drive surfaces of the drive element. Thus, the auxiliary spindle nut will initially not be displaced either, and it is rather that the spindle displaces the auxiliary spindle not before contact is also provided between one of the contact surfaces and with the corresponding drive surfaces of the spindle nut. Thus, movement of the spindle nut housing will not occur before the clearance of the auxiliary spindle nut is compensated.

In another advantageous embodiment, the auxiliary spindle comprises no thread at all, but is merely formed as a sliding bearing.

In an especially advantageous embodiment, also the actuator is formed such that it will not act before the spindle nut has not initially been displaced by a specified path section. In accordance with operating the pusher dog of the spindle nut and the associated drive surfaces, there are also provided appropriate second drive surfaces for the actuator, which are also spaced apart from each other. The operating principle is the same; it is merely the distance between the first drive surfaces of the drive member of the door wing, which, for example, may be larger than the distance of the second drive surfaces for the actuator. In in this case, the actuator also acts before contacting the contact surfaces of the pusher dog of the spindle nut with the associated first drive surfaces.

BRIEF DESCRIPTION OF THE DRAWINGS

The disclosure will be explained in more detail by way of the following figures, wherein.

DETAILED DESCRIPTION OF THE DRAWINGS

Figure 1:
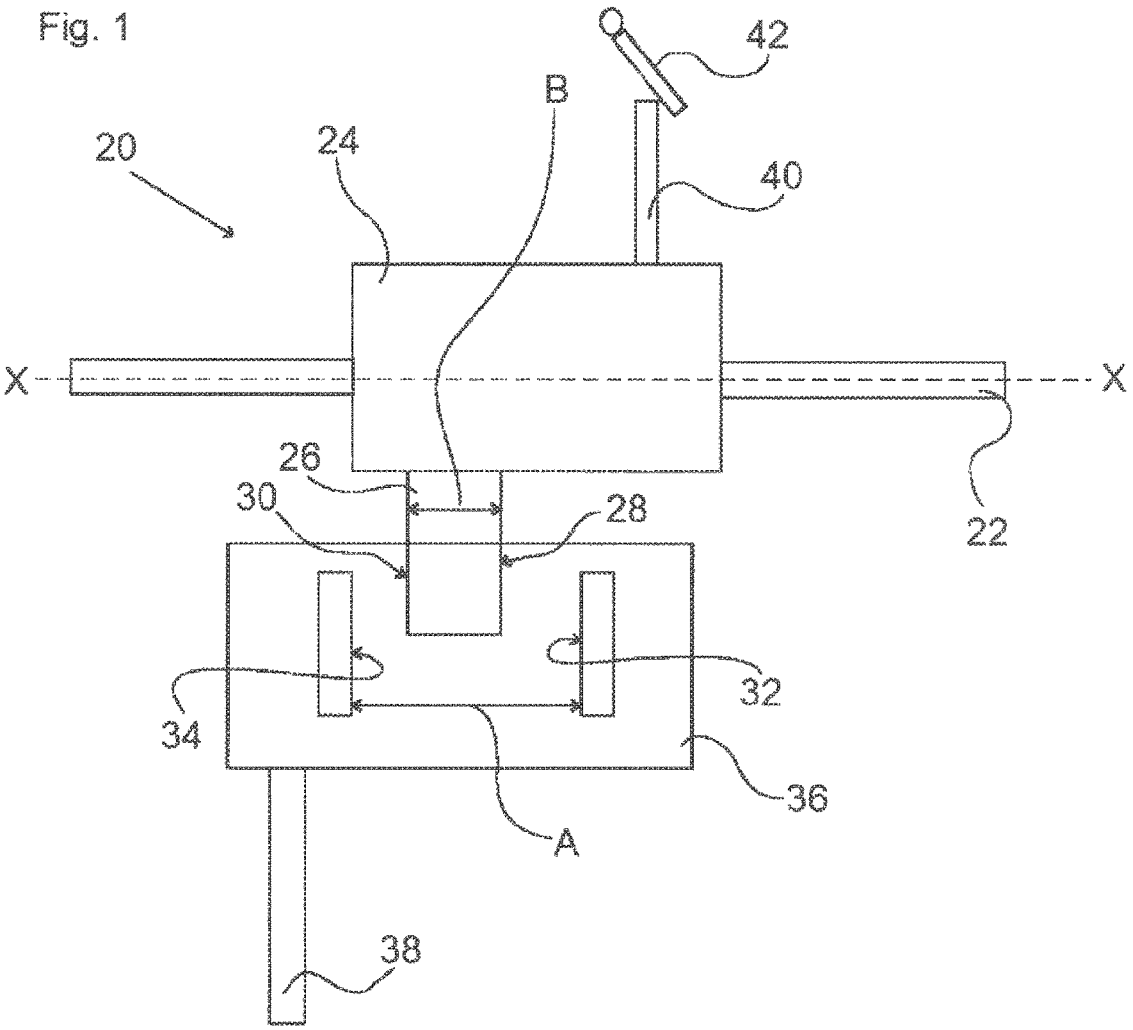
FIG. 1: is a strongly simplified conceptual draft of a spindle drive according to the disclosure.

FIG. 1 illustrates the basic operating principle of a spindle drive 20 according to the disclosure. A spindle 22 extends through a spindle nut 24 and has a longitudinal axis X-X. The spindle nut 24 is displaceable along the spindle 22 along the longitudinal axis X-X.

The spindle nut 24 comprises a pusher dog 26, which comprises a first contact surface 28 and a second contact surface 30. The two contact surfaces are facing in opposite directions along the longitudinal axis X-X.

The pusher dog 26 or the contact surfaces 28, 30 may be brought into contact with a first drive surface 32 or a second drive surface 34 by displacing the spindle nut 24. The two drive surfaces 32, 34 are firmly connected to a drive member 36, which in turn, is coupled to a member to be displaced, for example a door wing, via a holder 38. A distance A between the two drive surfaces 32, 34 exceeds a distance B between the two contact surfaces 28, 30, so that the pusher dog 26 is displaceable between the two drive surfaces 32, 34, without the contact surfaces 28, 30 and the drive surfaces 32, 34 contacting each other or displacing the drive member 36, respectively.

Furthermore, an actuator 40 is shown, which also is firmly connected to the spindle nut 24. Another member, preferably a locking device, may be actuated via the actuator. In the conceptual draft shown, a rocker arm 42 may be seen for this purpose as an example, which is operated by the actuator 40. What is essential is that the rocker arm 42 will be operated before the respective contact surface 28, 30 will come into contact with the corresponding drive surface 32, 34. The rocker arm 42 may be spring-loaded, to be reset into the original position following actuation. Thus, it is possible according to the disclosure, to initiate or to actuate two totally different operations via the spindle nut 24, respectively.

Figure 2:
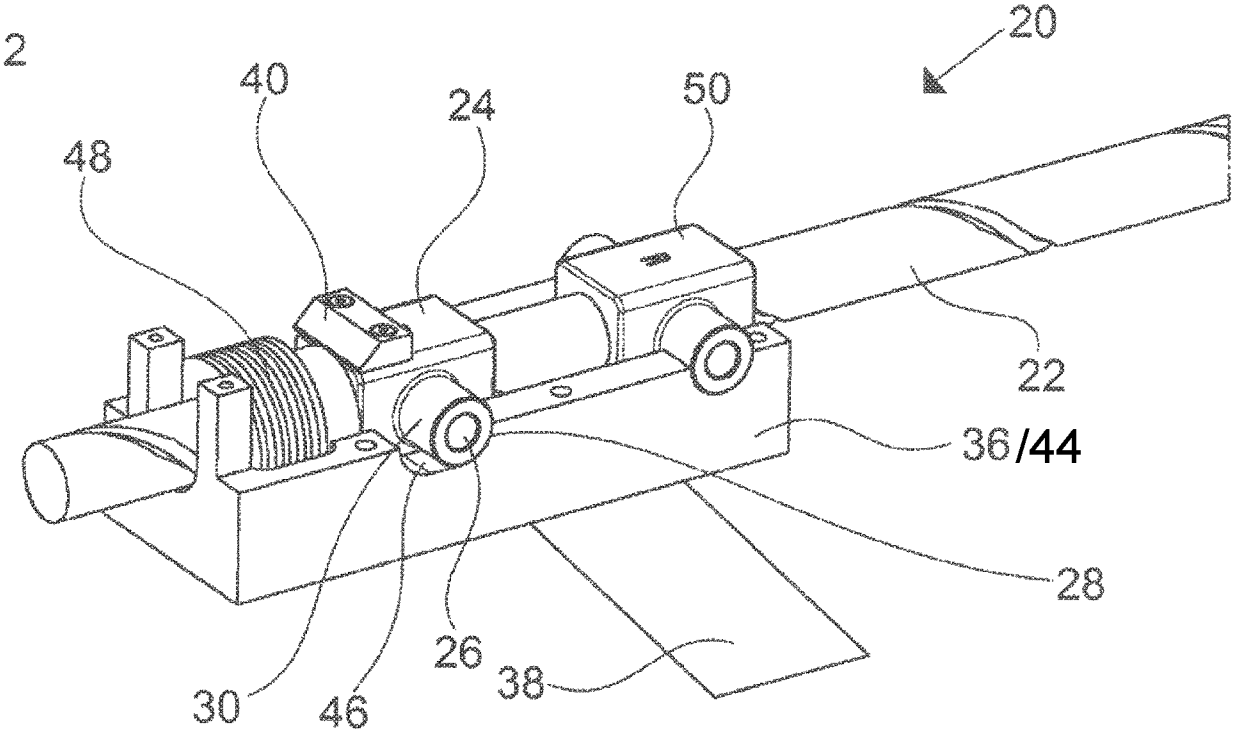
FIG. 2: is a first embodiment of a spindle drive according to the disclosure in perspective representation.

FIG. 2 shows another embodiment of the disclosure, which is suitable especially for the drive of a door wing or window wing. As a drive member 36, a spindle nut housing 44 is provided herein, which comprises an elongated hole 46. The elongated hole 46 essentially extends along the longitudinal axis X-X. The holder 38 is attached to the spindle nut housing 44, via which holder a door wing, which is not shown, is drivable.

The elongated hole 46, at its end, forms the two drive surfaces 32, 34. In the working example shown, the pusher dog 26 is of round shape. The actuator 40 is as well attached to the spindle nut 24 and preferably is for unlocking a rotary latch.

Furthermore, a spring member 48 is shown, which counteracts unwanted clearance of the spindle drive 20.

Furthermore, an auxiliary spindle nut 50 is disposed within the spindle nut housing 44 and is also driven by the spindle 22. In order to avoid displacement of the spindle nut housing 44, while the pusher dog 26 is disengaged with the drive surfaces 32, 34, the auxiliary spindle nut 50 has increased play or clearance, in the interior. It is not before this play has been overcome, that the auxiliary spindle nut 50 drives the spindle nut housing 44. The play and the length of the elongated holes 46 are adapted to each other, such that the contact between the contact surfaces 28, 30 and the drive surfaces 32, 34 will not be made before also the play within the auxiliary spindle nut 50 has been overcome.

The disclosure is not limited to the working example shown, but is suitable for all drive systems, which may be included in a spindle drive 20. Instead of locking devices, also other members may be driven via the actuator 40.

The invention claimed is:

1. A spindle drive for a member to be driven, comprising a driven spindle with a longitudinal axis X-X, which extends through a spindle nut, wherein the spindle nut comprises a pusher dog having a first contact surface and a second contact surface configured to drive the member, said first contact surface disposed opposite said second contact surface along the longitudinal axis X-X of the spindle, a first drive surface of the member arranged parallel to a second drive surface of the member are provided and spaced apart from each other along the longitudinal axis X-X of the spindle, a distance A between the first and second drive surfaces exceeds a distance B between the first and second contact surfaces, and an actuator connected to the spindle nut is configured for actuating a locking device, when the pusher dog is being disposed between the first and second drive surfaces, wherein the locking device is actuated before at least one of the first and second contact surfaces contacts at least one of the first and second drive surfaces, wherein the member comprises a spindle nut housing that houses the spindle nut, wherein in the spindle nut housing an elongated hole is provided, which forms the first drive surface and the second drive surface, and the pusher dog comprising the first contact surface and the second contact surface and projecting into the elongate hole, wherein a spring member is disposed within the spindle nut housing and is configured to counteract unwanted clearance in the longitudinal direction of the longitudinal axis X-X of the spindle.

2. The spindle drive according to claim 1, wherein the locking device is a rocker arm.

* * * * *